United States Patent [19]

Perrone et al.

[11] 4,346,568

[45] Aug. 31, 1982

[54] METHOD AND APPARATUS FOR SECURING TUBES IN AN AIR CONDITIONING UNIT

[75] Inventors: Terrence J. Perrone, Rochester; Theodore S. Bolton, Liverpool; Cosimo Caronna, Syracuse, all of N.Y.

[73] Assignee: Carrier Corporation, Syracuse, N.Y.

[21] Appl. No.: 264,910

[22] Filed: May 18, 1981

[51] Int. Cl.[3] ..... F25D 23/12

[52] U.S. Cl. ..... 62/259.1; 62/298; 248/56; 248/74 R

[58] Field of Search ..... 248/56, 74 R; 403/240; 285/194, 195, 205; 174/65 R; 62/259.1, 259.2, 298

[56] References Cited

U.S. PATENT DOCUMENTS

| | | | |
|---|---|---|---|
| 2,682,159 | 6/1954 | Trask | 62/262 |
| 3,092,360 | 6/1963 | Cook et al. | 248/56 |
| 3,301,166 | 1/1967 | Schwartz | 62/262 X |
| 3,611,743 | 10/1971 | Manganaro | 62/262 X |
| 4,029,277 | 6/1977 | Bulanda | 248/74 R |
| 4,163,372 | 8/1979 | Frye et al. | 62/259.1 |
| 4,188,003 | 2/1980 | Ramsey | 248/56 |

*Primary Examiner*—Lloyd L. King

*Attorney, Agent, or Firm*—J. Raymond Curtin; Robert P. Hayter

[57] ABSTRACT

A method and apparatus for securing tubes in a partition of an air conditioning unit. A tube seal is provided having slits for engaging the side walls of a partition opening in a partition dividing an air conditioning unit into an indoor section and an outdoor section. A tube receiving slit is provided in the seal such that upon assembly of the partition to the unit the refrigerant carrying tubes are secured within the seal. Additionally, extension portions from the seal extend downwardly and upon assembly are compressed to force the material of the seal to surround the tubes as well as the partition opening to provide a seal for reducing air flow between the indoor section and outdoor section of the air conditioning unit.

11 Claims, 4 Drawing Figures

METHOD AND APPARATUS FOR SECURING TUBES IN AN AIR CONDITIONING UNIT

BACKGROUND OF THE INVENTION

1. Field of the Invention

The present invention relates to air conditioning units having an evaporator section and a condenser section within one unit. More particularly, the present invention relates to an apparatus and method for securing refrigerant carrying tubes in an opening through a partition dividing an air conditioning unit into an indoor section and an outdoor section.

2. Prior Art

Air conditioning units such as the so called self-contained air conditioning units commonly used for residential and similar applications generally include closed refrigeration circuits having an evaporator and a condenser. The unit is normally divided by a partition into an evaporator section and a condenser section, the evaporator section communicating with the room air to be conditioned and the condenser section communicating with external air such as outdoor air. Refrigerant flows through a refrigeration circuit absorbing heat from the room air at the evaporator and discharging heat energy to the external air at the condenser. The conventional refrigeration circuit is completed by the addition of a compressor and an expansion device and the appropriate connections between the components.

In the evaporator section air is drawn through the evaporator by the evaporator fan and subsequently discharged into the room. In the evaporator the refrigerant changes from a liquid state to a gaseous state absorbing heat energy from the room air being circulated thereover. The gaseous refrigerant from the evaporator is returned to the compressor wherein its pressure and temperature are increased. The evaporator is located in the indoor section and the compressor is located in the outdoor section. From the compressor the hot gaseous refrigerant flows through the condenser wherein it is cooled to change state from a gas to a liquid. Heat energy is discharged to ambient air being circulated over the condenser by the condenser fan. This liquid refrigerant is then conducted through the partition dividing the unit into the door and outdoor sections back to the indoor coil or evaporator to complete the refrigeration circuit.

In a conventional room air conditioning unit the condenser and compressor being the heat discharging components are located in that portion of the unit, the outdoor section, wherein heat energy is discharged to the ambient air. The evaporator and evaporator fan are located in the indoor section of the unit for absorbing heat energy from the air to be cooled. In a conventional room air conditioning unit it is necessary to have two refrigerant line connections between the indoor section and the outdoor section. An interconnecting line between the condenser and evaporator and the suction line from the evaporator to the compressor are both required to pass through the partition.

With the advent of high energy costs, improving the overall performance of an air conditioning unit has achieved additional significance. One method of improving performance is to reduce the internal energy losses in an air conditioning unit including reducing the transfer of heat energy between the outdoor section and the indoor section of a unit. One of the modes in which this heat transfer may occur is by air leakage through the partition at the location where the refrigerant lines extend through the partition.

The present invention concerns providing a partition opening through which the suction line and refrigerant interconnecting line may extend. A tube seal formed from an expanded cellular foam is provided having slots to mount the tube seal to the partition at the opening. The tube seal additionally has a center slit for receiving the refrigerant carrying tubes and securing same therebetween. This combination acts to provide a tight seal preventing air flow through the partition wherein the refrigerant tubes extend.

SUMMARY OF THE INVENTION

An object of the present invention is to provide a method of assembling an air conditioning unit.

A further object of the present invention is to provide a method of assembling an air conditioning unit wherein a tight seal is formed where the refrigerant lines pass through the partition.

A further object of the present invention is to provide a partition opening and seal arrangement for securing refrigerant carrying tubes therein.

A further object of the present invention is to provide a safe, economical and reliable apparatus and method of manufacture of an air conditioning unit.

Other objects will be apparent from the description to follow and the appended claims.

The preceeding objects are achieved according to the preferred embodiment of the invention by the provision of an air conditioning unit having a partition dividing the unit into an indoor section and an outdoor section. The partition additionally defines a partition opening through which refrigerant carrying tubes extend. A tube seal having vertically extending slits at each end thereof is mounted to the partition by securing the seal to the partition at the edges of the partition adjacent the partition opening such that said edges extend into the slits of the tube seal. The refrigerant carrying tubes are then slid into a center slit of the seal wherein they are surrounded and encompassed by the tube seal material. Additionally, the tube seal may have projecting portions which are compressed against the base pan of the unit upon assembly thereby compressing the entire seal to form a tight closure reducing air flow between the indoor section and the outdoor section of the air conditioning unit.

DESCRIPTION OF THE PREFERRED EMBODIMENT

The embodiment described below is for use in a self-contained room air conditioning unit. It is to be understood that similar seal arrangements may be provided in other types of self-contained units and in other units wherein there is an air flow dividing member having tubes extending therethrough. It is to be additionally understood that although this invention has been described relative to refrigerant carrying tubes other items extending through the partition or air blocking surface of an air handling unit such as a temperature sensing element, wires, capillary tubes and other similar devices might likewise be enclosed in such a seal.

Figure 1:
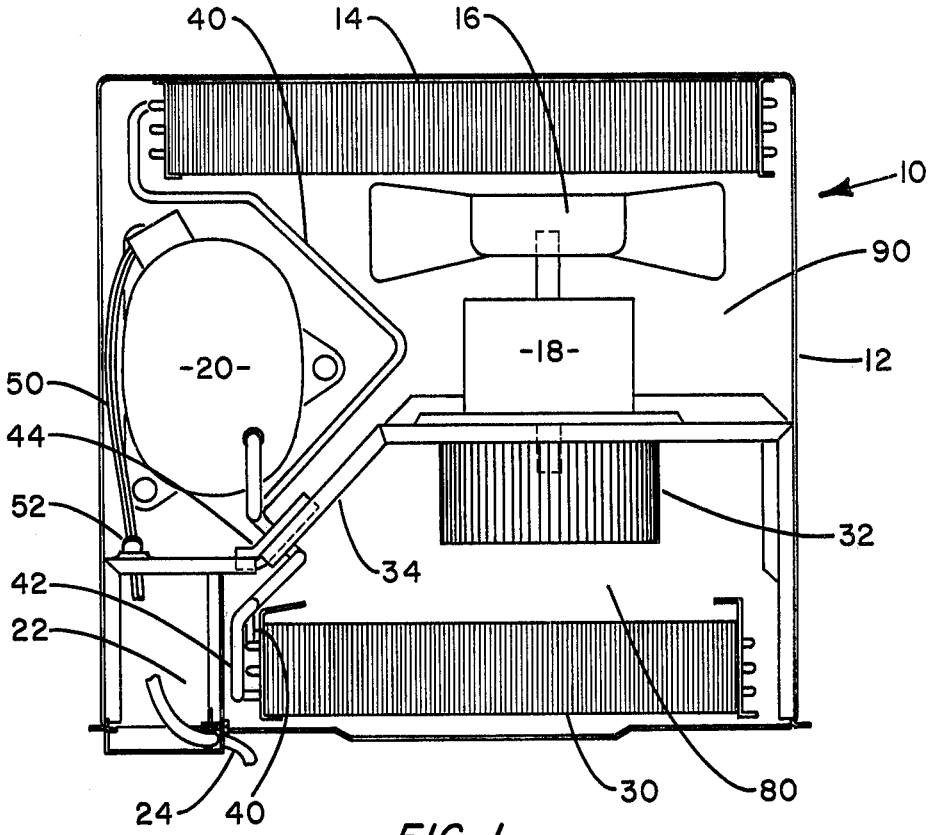
FIG. 1 is a top view of an air conditioning unit.

Referring now to FIG. 1 there can be seen an air conditioning unit 10 mounted to base pan 12. Partition 34 divides the unit into indoor section 80 and outdoor section 90. Within indoor section 80 are evaporator 30, evaporator fan 32 and control box 22. Within indoor section 90 are located fan motor 18, condenser fan 16, condenser 14 and compressor 20. Hence, all the heat generating elements are located in the outdoor section and the evaporator for absorbing heat energy from the indoor air is located in the indoor section. If the unit described was a heat pump, a four-way valve would be included and the function of the heat exchangers would be reversible. A refrigerant line referenced as interconnecting line 40 is shown connecting condenser 14 to evaporator 30. Suction line 42 is shown connecting the evaporator to compressor 20. Both lines extend through partition 34 at seal 44. It may also be seen in FIG. 1 that wires 50 from compressor 20 extend through wire seal 52 in the partition to control box 22. Additionally, a power cord 24 extends from the control box.

Figure 2:
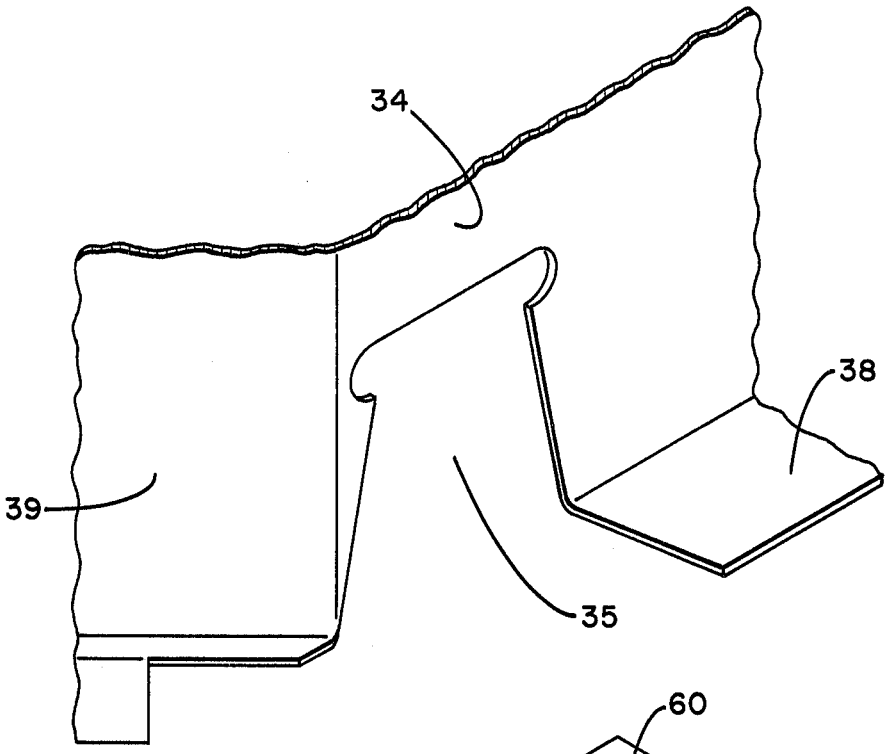
FIG. 2 is a perspective view of a portion of a partition of the air conditioning unit.

A portion of partition 34 is shown in FIG. 2. Partition opening 35 generally shaped like an overwide keyhole is formed therein. Partition opening 35 is wider at the bottom and narrows toward the top wherein it has an outwardly curving portion. Between the top and the outwardly curving portion are somewhat pointed edges which may serve to secure the seal to the partition. Flange 38 extends at right angles to the partition and is designed to rest on the base pan at the bottom of the unit. Angled portion 39 of the partition is formed at an angle different from the plane of partition 34 adjacent thereto. The change in angle of the partition may be seen in FIG. 1.

Figure 3:
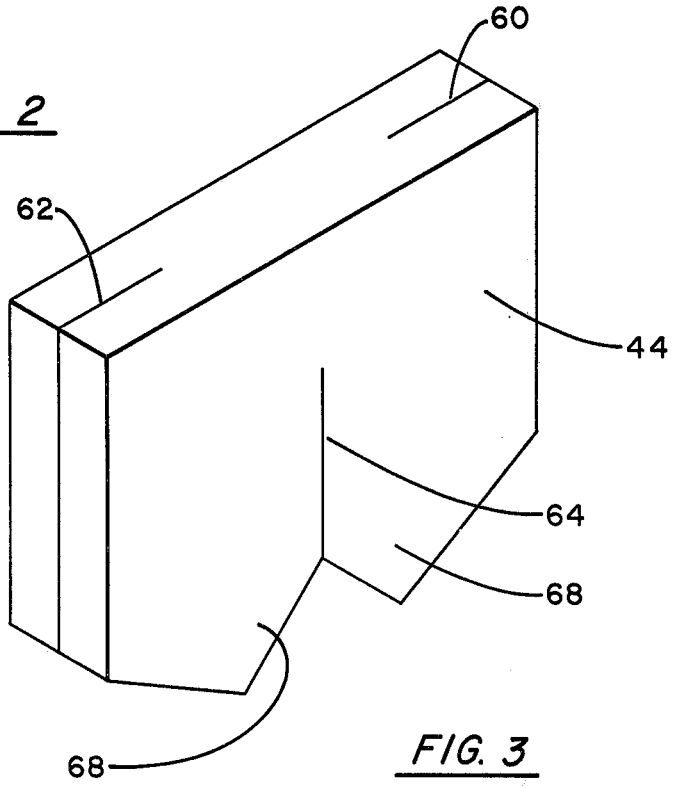
FIG. 3 is a perspective view of a tube seal as described herein.

Tube seal 44 is shown in perspective in FIG. 3. The tube seal is generally rectangular in configuration and formed from a block of sealing material. It has been found that expanded cellular foam is particularly suitable material although other flexible compressible materials might serve as well. Vertical slits 60 and 62 extend inwardly from the edges of tube seal 44 and extend vertically the length thereof. Line receiving slit 64 extends upward from the bottom of the tube seal such that the refrigerant carrying lines may be inserted therein. Projection portions 68 extend downwardly from the bottom of the tube seal and provide excess material to be compressed upon assembly as well as surfaces for guiding tubes into the line receiving slit 64.

Figure 4:
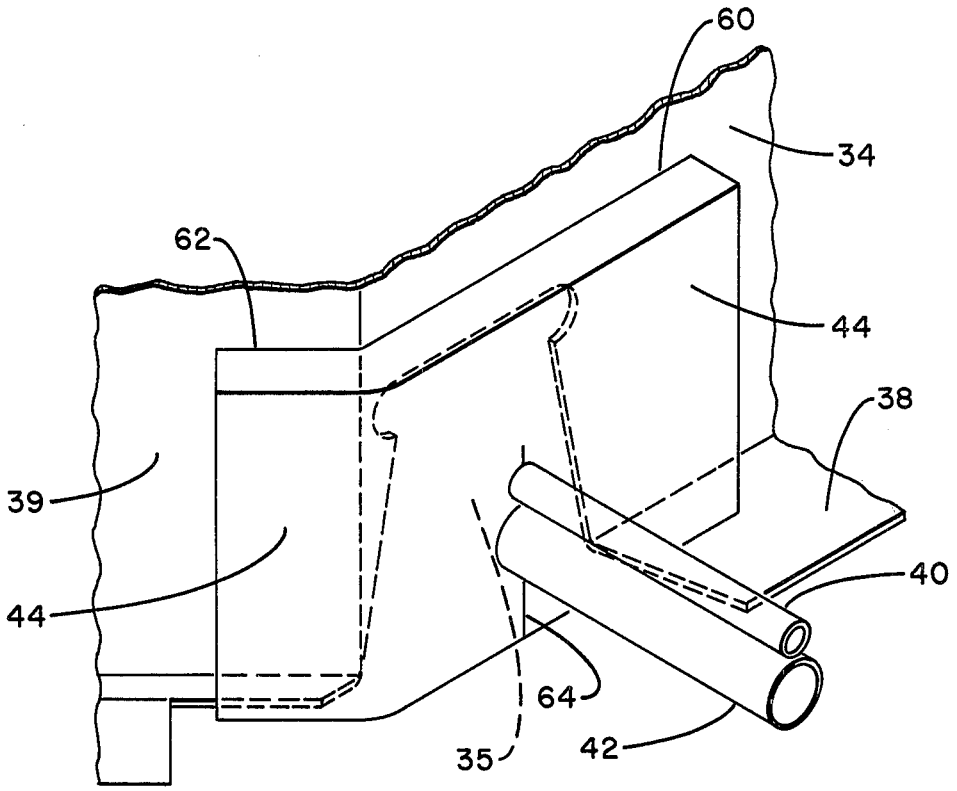
FIG. 4 is a perspective view of a portion of the partition having the tube seal and refrigerant carrying lines assembled therein.

Referring now to FIG. 4, the tube seal assembled to the partition with the refrigerant carrying lines contained therein is shown. It can be seen that the tube seal is flexible and is mounted with the edges of the partition adjacent partition opening 35 extending into vertical slits 60 and 62. It is additionally seen that the tube seal is bent around that angled portion 39 extends into vertical slit 62 while the other part of the partition 34 extends into the remaining vertical slit 60. As shown in FIG. 4, the tube seal is mounted in contact with the base pan (not shown) such that the projection portions 68 are flattened upwardly. By flattening these projections upwardly the entire seal is compressed and the seal material surrounding the location of the suction line 42 and interconnecting line 40 in line receiving slit 64 encases the tubes forming a seal. Bottom flange portion 38 is mounted to engage the base pan to provide support for the partition.

METHOD OF ASSEMBLY

In the assembly of an air conditioning unit typically the condenser, compressor and evaporator are mounted to the base pan. The partition having the condenser and evaporator fans as well as fan motor 18 mounted thereto is assembled to the base pan. Utilizing the present tube seal the tube seal is slid with vertical slits 60 and 62 onto the edges of partition opening 35 and the adjacent partition walls such that the tube seal is supported therefrom. As the partition is then assembled by assembling the same downwardly onto the unit the refrigerant carrying lines, suction line 42 and interconnecting line 40, are then slid upwardly into line receiving slit 64 to the position as shown in FIG. 4. Hence, the tubes are secured within the tube seal by merely displacing the partition 34 downwardly to the position as shown in FIG. 1. The partition is then secured to the base pan utilizing screws or other similar devices.

The apparatus has been described herein with reference to a particular embodiment, however, it is to be understood that variations and modifications can be effected within the spirit and scope of the invention. This device has been described with particular reference to a room air conditioning unit. It is to be understood that this invention has like applicability to units other than room units and to machines designed to perform functions other than just cooling such as heat pump or refrigeration equipment.

What is claimed is:

1. An air conditioning unit including a base pan which comprises:

an indoor section in communication with the space to be conditioned including an indoor heat exchanger and means for circulating air to be conditioned in heat exchange relation with the indoor heat exchanger;

an outdoor section in communication with ambient air and including an outdoor heat exchanger and a compressor;

a partition mounted to the base pan for dividing the air conditioning unit to separate the indoor section from the outdoor section, said partition further defining a partition opening;

a refrigerant carrying line extending between the indoor section and the outdoor section through the partition opening; and a block of sealing material, said block defining at least one slit for engaging a portion of the partition at the partition opening and a line receiving slit for receiving the refrigerant carrying line, said block including excess material whereby upon the assembly of the partition to the base pan the partition opening is fully sealed with the refrigerant carrying line extending therethrough.

2. The apparatus as set forth in claim 1 wherein the block of sealing material is generally rectangular in configuration and includes vertical slits formed in opposite vertical sides of the block each for engaging a side of the partition opening, a vertically extending line receiving slot located approximately in the center of the block of material such that the projection portions are forced upwardly when assembled to promote sealing of the edges of the block of sealing material with the partition and the center of the block of sealing material with the refrigerant carrying line.

3. The apparatus as set forth in claim 2 wherein the partition includes a portion angled from another part of the partition and wherein the block of sealing material engages the partition and the angled portion of the partition.

4. The apparatus as set forth in claim 1 wherein the block of sealing material comprises an expanded cellular foam.

5. An assembly for use with an air conditioning unit having a base pan upon which components are mounted which comprises:

a thin walled partition dividing the air conditioning unit into an indoor section and an outdoor section, said partition defining an opening therein through which a refrigerant line may pass; and a tube seal of a generally rectangular configuration having vertically extending slits on each edge for allowing sliding engagement with the edges of the partition defining the partition opening for securing the tube seal to the partition opening and further defining a line receiving slit into which the refrigerant line is mounted such that the sealing material of the tube seal surrounds the line reducing air flow between the indoor section and outdoor sections of the air conditioning unit.

6. The apparatus as set forth in claim 5 wherein the tube seal further comprises projection portions extending downwardly and wherein the partition opening is located at the bottom of the partition whereby upon assembly of the unit the tube seal is mounted to the bottom of the partition and the projection portions of the tube seal are compressed against the base pan thereby compressing the entire tube seal.

7. The apparatus as set forth in claim 5 wherein the seal comprises a flexible expanded cellular foam material and wherein the partition opening is wider at the bottom of the partition and narrower at the top of the opening.

8. A method of assembling air conditioning unit components to a base pan which comprises the steps of:

mounting the refrigeration circuit components having at least one refrigerant line attached thereto to the base pan;

providing a partition for separating an indoor section of the air conditioning unit from an outdoor section, said partition including a partition opening through which the refrigerant line may extend;

sliding a tube seal having slits acting as partition edge receiving openings and a line receiving slit into the partition opening such that the tube seal is secured with the partition opening edges within the slits; and placing the partition and tube seal subassembly onto the base pan with the refrigerant line being received in the tube receiving slit of the seal and the partition dividing the unit into an indoor section and an outdoor section, said seal engaging the line to reduce air flow through the partition at the partition opening.

9. The method as set forth in claim 8 wherein the tube seal includes downwardly projecting portions extending below the partition and wherein the step of placing further comprises the step of:

compressing the tube seal by squeezing the projection portions against the base pan as the partition is placed in position whereby the entire tube seal is compressed forming a tighter seal against the partition opening edges and the refrigerant line.

10. The method as set forth in claim 9 wherein the step of mounting includes a plurality of refrigerant lines and the step of placing includes securing a plurality of refrigerant lines within the tube seal.

11. The method as set forth in claim 8 wherein the step of providing includes providing a partition which is angled in the vicinity of the partition opening and wherein the step of sliding includes bending the tube seal and sliding it onto the angled partition surfaces.

* * * * *